US005661308A

United States Patent [19]

Benveniste et al.

[11] Patent Number: 5,661,308

[45] Date of Patent: Aug. 26, 1997

[54] METHOD AND APPARATUS FOR ION FORMATION IN AN ION IMPLANTER

[75] Inventors: Victor M. Benveniste, Gloucester; Michasel Cristoforo, Beverly, both of Mass.

[73] Assignee: Eaton Corporation, Cleveland, Ohio

[21] Appl. No.: 655,448

[22] Filed: May 30, 1996

[51] Int. Cl.[6] ..... H01J 27/00

[52] U.S. Cl. ..... 250/492.21; 250/423.2; 250/424; 315/111.81

[58] Field of Search ..... 250/492.21, 423.12, 250/424, 492.2; 315/111.21, 111.51, 111.71, 111.81

[56] References Cited

U.S. PATENT DOCUMENTS

| | | | |
|---|---|---|---|
| 4,447,732 | 5/1984 | Leung et al. | 250/427 |
| 4,486,665 | 12/1984 | Leung et al. | 250/423 R |
| 4,883,968 | 11/1989 | Hipple et al. | 250/423 R |
| 5,023,458 | 6/1991 | Benveniste et al. | 250/492.21 |
| 5,164,599 | 11/1992 | Benveniste | 250/492.2 |
| 5,283,538 | 2/1994 | Geisler et al. | 315/111.21 |
| 5,387,843 | 2/1995 | Magayama et al. | 315/111.81 |
| 5,397,962 | 3/1995 | Moslehi | 315/111.81 |

*Primary Examiner*—Jack I. Berman
*Assistant Examiner*—Kiet T. Nguyen
*Attorney, Agent, or Firm*—Watts, Hoffmann, Fisher & Heinke Co., L.P.A.

[57] ABSTRACT

An ion source for use in an ion implanter. The ion source includes a gas confinement chamber having conductive chamber walls that bound a gas ionization zone. The gas confinement chamber includes an exit opening to allow ions to exit the chamber. A base positions the gas confinement chamber relative to structure for forming an ion beam from ions exiting the gas confinement chamber. A supply of ionizable material routes the material into the gas confinement chamber. An antenna that is supported by the base has a metallic radio frequency conducting segment mounted directly within the gas confinement chamber to deliver ionizing energy into the gas ionization zone.

13 Claims, 2 Drawing Sheets

METHOD AND APPARATUS FOR ION FORMATION IN AN ION IMPLANTER

FIELD OF INVENTION

The present invention concerns a method and apparatus for generating ions for use in an ion beam implanter and, more particularly, to a method and structure for providing ionization energy to an ion source chamber in which a plasma of ions is created.

BACKGROUND OF THE INVENTION

Ion beam implanters are used to treat silicon wafers with an ion beam. Such treatment can be used to produce n or p type extrinsic materials doping or can be used to form passivation layers during fabrication of an integrated circuit.

When used for doping semiconductors, the ion beam implanter injects a selected ion species to produce the desired extrinsic material. Implanting ions generated from source materials such as antimony, arsenic or phosphorus results in 'n type' extrinsic material wafers. If 'p type' extrinsic material wafers are desired, ions generated with source materials such as boron, gallium or indium are implanted.

The ion beam implanter includes an ion source for generating positively charged ions from ionizable source materials. The generated ions are formed into a beam and accelerated along a predetermined beam path to an implantation station. The ion beam implanter includes beam forming and shaping structure extending between an ion source and the implantation station. The beam forming and shaping structure maintains the ion beam and bounds an elongated interior cavity or region through which the beam passes while travelling to the implantation station. When operating the implanter, this interior region must be evacuated to reduce the probability of ions being deflected from the predetermined beam path as a result of collisions with air molecules.

Eaton Corporation, assignee of the present invention, currently sells high current implanters under the product designations NV 10, NV-GSD/200, NV-GSD/160, and NV-GSD/80.

Ion sources that generate the ion beams used in the known implanters typically include heated filament cathodes that provide ionizing electrons to the confines of a source chamber. These electrons collide with ion producing materials injected into the source chamber to ionize the materials. These ions exit the source chamber through an exit aperture. After relatively short periods of use, the filament cathodes degrade and must be replaced so that ions can again be generated with sufficient efficiency.

The ionization process for an ion implanter source can also be set up and maintained by transferring power into the source chamber by means of an rf coupling antenna. The antenna is energized by an rf signal that creates an alternating current within the "skin layer" of the conductive antenna. The alternating current in the antenna induces a time varying magnetic field which in turn sets off an electric field in a region occupied by naturally occurring free electrons within the source chamber. These free electrons accelerate due to the induced electric field and collide with ionizable materials within the ion source chamber. The shape of the antenna dictates the shape of the electric field induced within the source chamber. Once the antenna provides a steady state transfer of power into the source chamber, electric currents in the plasma within the ion chamber are generally parallel to and opposite in direction to the electric currents in the antenna. Heretofore, it was not believed the antenna could be immersed directly within the plasma created by delivery of energy from the antenna to the interior of the source chamber. To provide electrical isolation, the antenna was coated with a dielectric material. The dielectric coating tended to erode with use and contaminate the plasma within the source chamber.

Examples of two prior art ion sources are disclosed in U.S. Pat. Nos. 4,486,665 and 4,447,732 to Lenng et al. These two patents disclose ion sources having filaments that provide ionizing electrons within an ion source chamber. These filaments are energized by a direct current power source. Direct currents pass through the filaments and cause electrons to be emitted into the source chamber. These electrons are accelerated to collide with atoms injected into the chamber to create ions for subsequent utilization.

DISCLOSURE OF THE INVENTION

The present invention concerns an ion source that may be used in conjunction with an ion implanter. The disclosed ion source uses an antenna to couple energy into an interior region of a chamber containing an ionizable material.

An apparatus constructed in accordance with one embodiment of the invention includes an ion source having conductive chamber walls that define a plasma chamber. The conductive walls bound an ionization region. The plasma chamber also defines an exit opening that allows ions to exit the plasma chamber. These ions are formed into a beam and caused to traverse a beam path for treating a workpiece. A base positions the plasma chamber relative to structure for forming an ion beam from ions exiting said plasma chamber.

A supply in communication with said plasma chamber delivers an ionizable material into the plasma chamber. The supply can for example provide an ionizable gas to an interior of the plasma chamber. A metallic antenna for delivering energy to the source chamber interior has a metal surface exposed within the chamber. The metallic antenna is coupled to an energy source for energizing the metallic antenna with an rf signal to set up an alternating electric current in said metallic antenna. The alternating current in the antenna induces an ionizing electric field in proximity to the metallic antenna within the plasma chamber.

Electric isolation is provided between the exposed metal of the antenna and the plasma set up within the chamber by the plasma sheath which defines a region of reduced charge density surrounding the antenna. Although this sheath is not an absolute insulating medium, its conductivity is considerably lower than both the plasma conductivity and the highly conductive metallic antenna. In relation to the very high electric currents flowing in both the plasma and the metallic antenna, the sheath can be considered to be an insulating barrier. The sheath region is very thin and therefor provides efficient coupling between the antenna and the plasma.

The metal chosen for the antenna is preferably very conductive. Most preferably the metal is chosen to be aluminum. The choice of aluminum also has the advantage that any aluminum that does sputter off from the antenna into the plasma is a relatively unobjectionable contaminant in semiconductor processing applications of an ion implanter. A preferred aluminum antenna is a tube having a large wall thickness to prolong the useful life of the antenna. Coolant is routed through the tube during operation of the ion source.

The above and other objects, advantages and features of the invention will be better understood from the following detailed description of a preferred embodiment of the invention which is described in conjunction with the accompanying drawings.

BEST MODE FOR PRACTICING THE INVENTION

Figure 1:
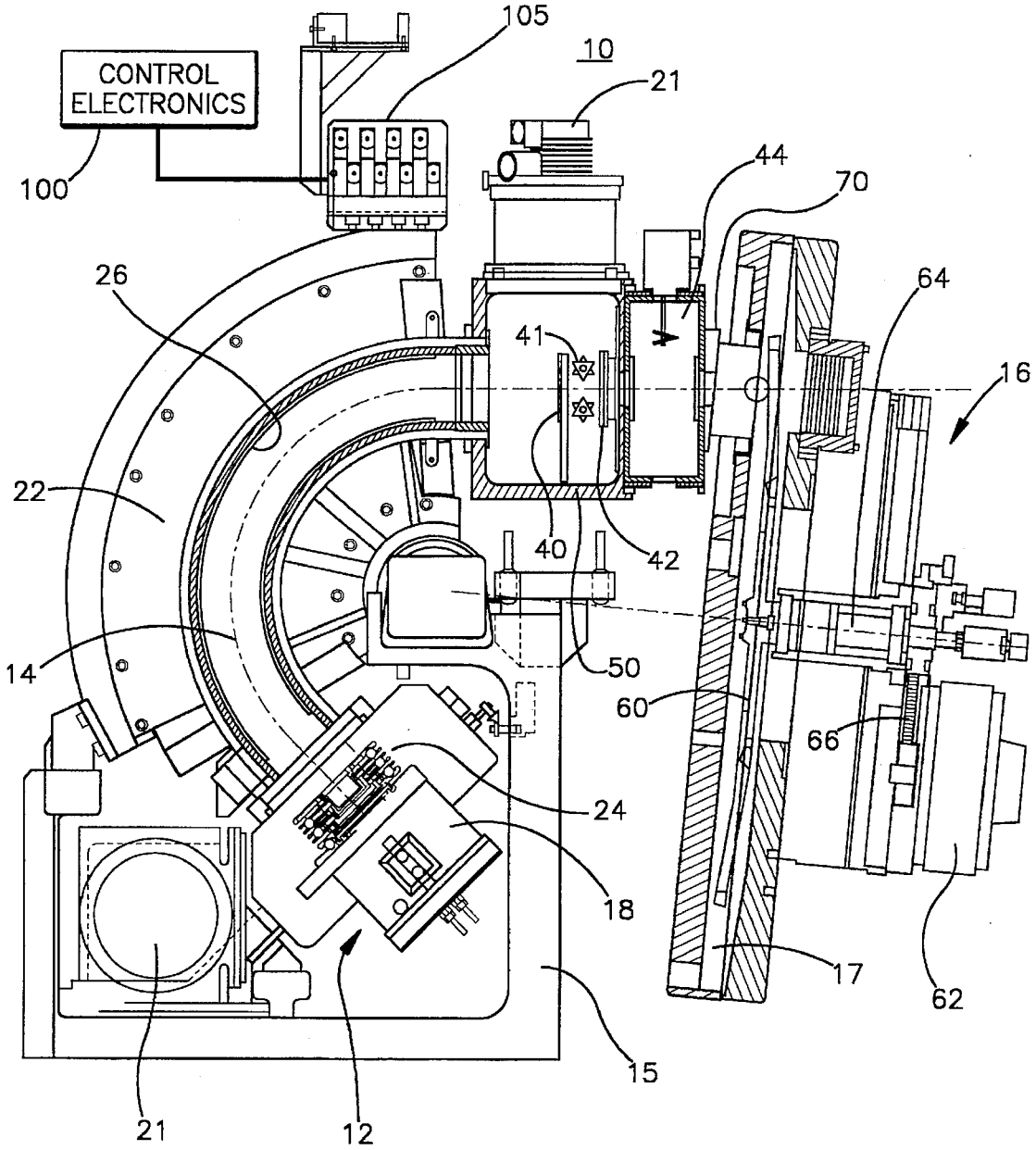
FIG. 1 is schematic view of an ion implanter for ion beam treatment of a workpiece such as a silicon wafer mounted on a spinning wafer support.

Turning now to the drawings, FIG. 1 depicts an ion beam implanter, shown generally at 10, which includes an ion source 12 mounted to an "L" shaped support 15. The source 12 emits ions that are accelerated and shaped into an ion beam 14 which traverses a beam path from the source 12 to an implantation station 16. Control electronics monitor the ion dosage received by wafers (not shown) supported within an implantation chamber 17 which forms a part of the implantation station 16. The ions in the ion beam 14 follow a predetermined, desired beam path through an evacuated region bound by structure between the source 12 and the implantation chamber 17.

The ion source 12 includes a plasma chamber 18 (FIG. 2) defining an interior region containing source materials that are ionized within the chamber. The source materials may be supplied in the form of an ionizable gas or vaporized source material. Certain source materials used in the ion implantation process are solids that are first vaporized and then routed into the plasma chamber 18 to be ionized.

As noted previously, a typical use of the ion beam is for doping a silicon wafer to form a semiconductor material. If an 'n' type intrinsic doping material is used, boron, gallium or indium will be used. Gallium and indium are solid source materials, while boron is injected into the plasma chamber 18 as a gas, typically boron trifluoride or diborane, because boron's vapor pressure is too low to result in a usable pressure by simply heating it.

If a 'p' type extrinsic material is to be produced, antimony, arsenic or phosphorus will be chosen as the solid source material. Energy is applied to the source materials to generate positively charged ions in the plasma chamber 18. The positively charged ions exit the plasma chamber interior through an elliptical slit in a cover plate overlying an open side of the plasma chamber 18.

The ion beam 14 travels through an evacuated path from the ion source 12 to an implantation chamber 17, which is also evacuated. Evacuation of the beam path is provided by vacuum pumps 21 and tends to reduce beam divergence due to ion beam collisions with other particles in the beam path. One application of an ion source 12 constructed in accordance with the present invention is for a "low" energy implanter. The ion beam 14 of this type of implanter tends to diffuse over its beam path and hence the implanter has been designed to have a relatively "short" path from the source to the implantation chamber.

Ions in the plasma chamber 18 are extracted through a slit 126 in a plasma chamber cover plate 124 and accelerated by a set of electrodes 24 adjacent the plasma chamber toward a mass analyzing magnet 22 fixed to the support 15. The set of electrodes 24 extracts the ions from the plasma chamber interior and accelerates the ions into a region bounded by the mass analyzing or resolving magnet 22. An ion beam path through the magnet is bounded by an aluminum beam guide 26.

Ions that make up the ion beam 14 move from the ion source 12 into a magnetic field set up by the mass analyzing magnet 22. The strength and orientation of the magnetic field produced by the magnet 22 is controlled by the control electronics 100 coupled to a magnet connector 105 for adjusting a current through the magnet's field windings.

The mass analyzing magnet 22 causes only those ions having an appropriate mass to charge ratio to reach the ion implantation station 16. The ionization of source materials in the plasma chamber 18 generates a species of positively charged ions having a desired atomic mass. However, in addition to the desired species of ions, the ionization process will also generate a proportion of ions having other than the proper atomic mass. Ions having an atomic mass above or below the proper atomic mass are not suitable for implantation.

The magnetic field generated by the mass analyzing magnet 22 causes the ions in the ion beam to move in a curved trajectory. The magnetic field that is established by the control electronics 100 is such that only ions having an atomic mass equal to the atomic mass of the desired ion species traverse the curved beam path to the implantation station chamber 17.

Located downstream from the magnet is a resolving plate 40. The resolving plate 40 is comprised of vitreous graphite and defines an elongated aperture through which the ions in the ion beam 14 pass. At the resolving plate 40 the width of the ion beam envelope is at a minimum.

The resolving plate 40 functions in conjunction with the mass analyzing magnet 22 to eliminate undesirable ion species from the ion beam 14 which have an atomic mass close to, but not identical, to the atomic mass of the desired species of ions. As explained above, the strength and orientation of the mass analyzing magnet's magnetic field is established by the control electronics 100 such that only ions having an atomic weight equal to the atomic weight of the desired species will traverse the predetermined, desired beam path to the implantation station 16. Undesirable species of ions having an atomic mass much larger or much smaller than the desired ion atomic mass are sharply deflected and impact the beam guide 26 or the slit boundary defined by the resolving plate 40.

As can be seen in FIG. 1, an adjustable resolving slit 41 and a Faraday flag 42 are located between the resolving slit 40 and an ion beam neutralizer 44. The Faraday flag is movably coupled to a housing 50 that bounds the beam line. The Faraday flag 42 can be moved linearly into position to intersect the ion beam 14 to measure beam characteristics and, when the measurements are satisfactory, swung out of the beam line so as to not interfere with wafer implantation at the implantation chamber 17. The adjustable resolving slit 41 includes two rotatable shields whose orientation is controlled to adjust the beam size downstream from the slit 40. In one orientation the two rotatable shields intersect a significant part of the beam and in a second orientation the beam is not narrowed. By choice of orientations intermediate these two extremes the size of the beam can be controlled.

The beam forming structure 13 also includes the ion beam neutralization apparatus 44, commonly referred to as an electron shower. U.S. Pat. No. 5,164,599 to Benveniste, issued Nov. 17, 1992, discloses an electron shower apparatus in an ion beam implanter and is incorporated herein in its entirety by reference. The ions extracted from the plasma chamber 18 are positively charged. If the positive charge on the ions is not neutralized prior to implantation of the wafers, the doped wafers will exhibit a net positive charge. As described in the '599 patent, such a net positive charge on a wafer has undesirable characteristics.

A downstream end of the neutralizer 44 is adjacent the implantation chamber 17 where the wafers are implanted with ions. Rotatably supported within the implantation chamber is a disk shaped wafer support 60. Wafers to be treated are positioned near a peripheral edge of the wafer support and the support is rotated by a motor 62. An output shaft of the motor 62 is coupled to a support drive shaft 64 by a belt 66. The ion beam 14 impinges and treats the wafers as they rotate in a circular path. The implantation station 16 is pivotable with respect to the housing 50 and is connected to the housing 50 by a flexible bellows 70 (FIG. 1).

Plasma chamber 18

Figure 2:
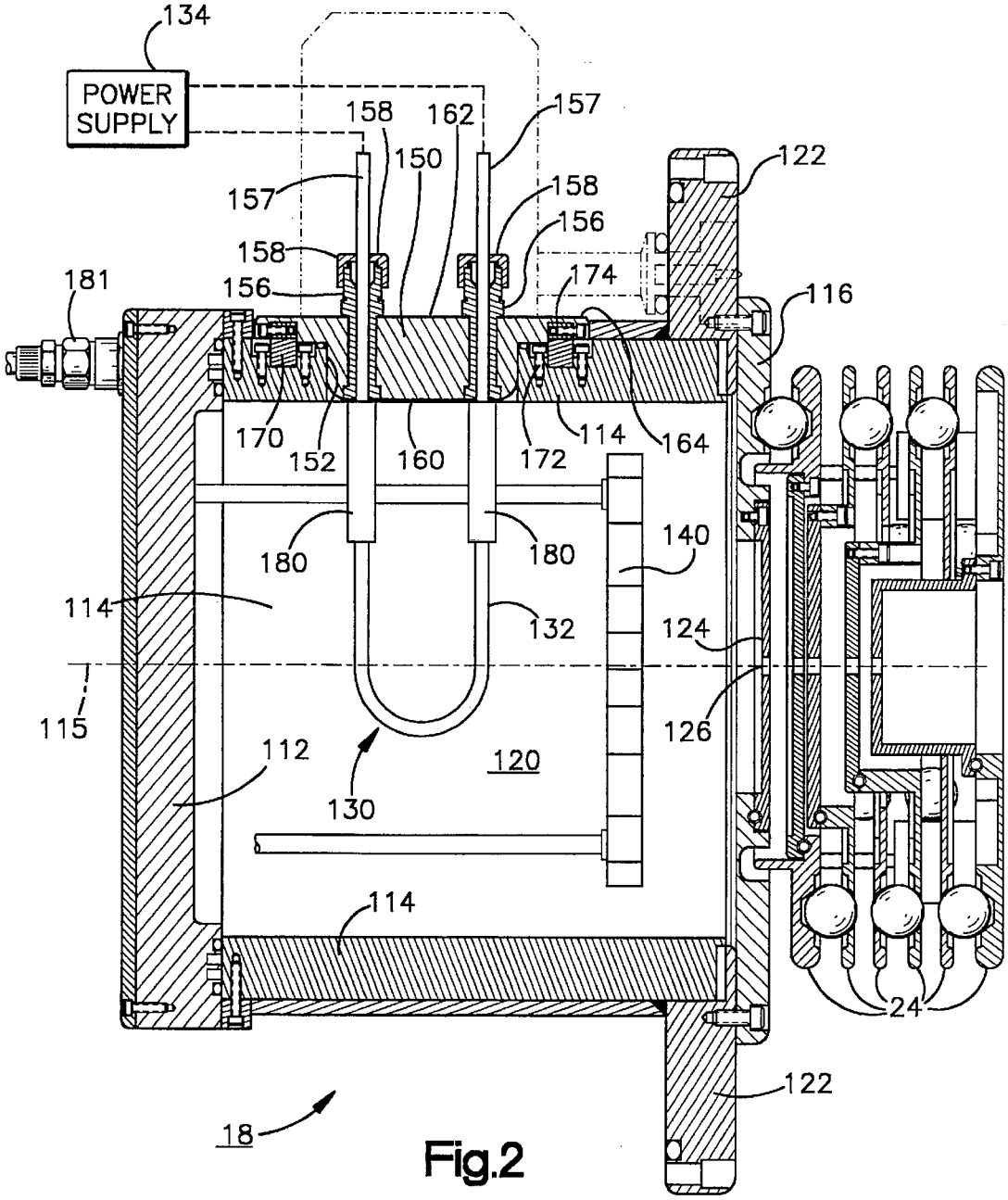
FIG. 2 is a partial cross-sectional view of an ion generating source embodying the present invention for creating an ion beam in the implanter of FIG. 1.

The ion source 12 is shown in FIG. 2 to include a plasma chamber 18 constructed in accordance with the present invention. The plasma chamber 18 has conductive chamber walls 112, 114, 116 that bound an ionization zone 120 in a chamber interior. A side wall 114 is circularly symmetric about a center axis 115 of the plasma chamber 18.

A conductive wall 116 that faces the resolving magnet 22 is connected to a plasma chamber support 122. This wall 116 supports an aperture plate 124 having multiple openings that allow ions to exit the plasma chamber 18 and then combine to form the ion beam 14 at a location downstream from multiple spaced apart and electrically isolated extraction electrodes 24. The aperture plate 124 includes a number of openings arranged in a specified pattern that align with similarly configured multiple apertures in the spaced apart extraction electrodes. Only one of the apertures 126 is shown in the FIG. 2 aperture plate 124. Ion sources having patterns of multiple apertures for allowing ions to escape from source chambers are disclosed in U.S. Pat. No. 4,883,968 to Hippie et al and U.S. Pat. No. 5,023,458 to Benveniste et al which are assigned to the assignee of the present invention and which are incorporated herein by reference.

Ionizable material is routed from a source outside the chamber to the ionization region 120 inside the plasma chamber 18. The type and nature of the material depends on the type of materials being ionized.

A metallic antenna 130 has a metal surface 132 exposed within the chamber interior for emitting energy into the plasma chamber 18. A power supply 134 outside the plasma chamber 18 energizes the metallic antenna 130 with an rf signal to set up an alternating electric current in the metallic antenna that induces an ionizing electric field within the plasma chamber in close proximity to the metallic antenna 130.

The plasma chamber 18 also includes a magnetic filter assembly 140 extending through a region of the chamber interior between the antenna 130 and the aperture plate 124. The filter assembly operates in conformity of the teaching of U.S. Pat. No. 4,447,732 to Leung et at which is assigned to the United States government. The disclosure of the '732 patent to Leung et al is expressly incorporated herein by reference.

The antenna 130 is positioned within the plasma chamber 18 by a removable support plate 150. The support plate 150 is supported by the side wall 114 at a location having a circular cutout 152 through which the antenna extends. A support plate 150 for the antenna 130 is sized to fit within the cutout 152 in the chamber wall 114 while positioning the exposed U-shaped metal portion 132 of the antenna 130 within the ionization zone 120.

The support plate 150 defines two through passageways that accommodate two vacuum pressure fittings 156. After elongated leg segments 157 of the antenna 130 are pushed through the fittings, end caps 158 are screwed onto the fittings to seal the region of contact between the fittings 156 and the leg segments 157. The antenna 130 is preferably U-shaped in its radiation emitting region and is preferably constructed from aluminum. The tube has an outer diameter dimensioned to pass through the pressure fittings 156. While in use the antenna absorbs heat from its surroundings. To dissipate this heat a coolant is routed through the center of the tube.

The plate 150 has a generally planar surface 160 that is exposed to an interior of the plasma chamber and includes a parallel outer surface 162 that faces away from the chamber interior. A flanged portion 164 of the plate 150 overlies a ring magnet 170 that surrounds the cutout in the wall 114 and that is attached to the wall 114 by connectors 172. A ferromagnetic insert 174 attached to the support plate 150 fits over the magnet 170 so that as the plate 150 is positioned within the cutout 152 the ferromagnetic insert 174 and the magnet 170 attract each other to secure the plate 150 in position with the antenna 130 extending into the chamber interior.

During operation of the ion source, heat is generated and this heat is absorbed by the walls 112, 114, 116, 118. The absorbed heat is removed from the chamber 18 by a coolant that is introduced through a fitting 181 for routing water into a passageway through the walls and away from the chamber by a second exit fitting (not shown).

A region of the antenna 130 near the support plate 150 is particularly susceptible to coating with sputtered material during operation of the ion implanter. Two shields 180 are slipped over the aluminum antenna before the antenna is inserted into the support plate 150. These shields are most preferably constructed from aluminum and are maintained in place by a friction fit between the shields and the outer surface of the exposed aluminum of the antenna 130.

A preferred power supply 134 for energizing the antenna 130 is commercially available from Advanced Energy Inc. of Boston, Mass. This power supply provides a signal having a frequency of 13.5 Megahertz and is capable of supplying 3 kilowatts of power.

From the above description of a preferred embodiment of the invention, those skilled in the art will perceive improvements, changes and modifications. All such improvements, changes and modifications are intended to be covered which fall within the spirit or scope of the appended claims.

We claim:

1. An ion source for use in an ion implanter, said ion source comprising:

a) a plasma chamber for receiving an ionizable material, the plasma chamber having conductive chamber walls that bound an ionization zone in a chamber interior bounded by the conductive chamber walls, said plasma chamber including an exit opening that allows ions to exit the plasma chamber;

b) a support for positioning said plasma chamber relative to structure for forming an ion beam from said ions exiting said plasma chamber;

c) a metallic antenna including a metal surface exposed within the chamber interior for emitting energy into the plasma chamber, the antenna including two legs that are connected together within the plasma chamber, and wherein each of said legs has an end disposed outside said plasma chamber; and d) an energy source for energizing the metallic antenna with a radio frequency signal, said energy source having two outputs connected to the ends of the two legs of said antenna to set up an alternating electric current in said metallic antenna for inducing an ionizing electric field in proximity to the metallic antenna within the plasma chamber.

2. The ion source of claim 1 wherein the antenna is constructed of aluminum.

3. The ion source of claim 1 wherein the antenna is a thick walled metallic tube and further comprising an inlet for coolant to be pumped through the thick walled tube during operation of an ion implanter.

4. The ion source of claim 3 wherein the thick walled metallic tube comprises an aluminum surface that is exposed to a plasma set up within the plasma chamber.

5. The ion source of claim 4 wherein the thick walled metallic tube is generally U-shaped with the ends of said two legs forming the ends of the U and a portion connecting the legs including said aluminum surface exposed to the plasma set up within the plasma chamber.

6. The ion source of claim 1 wherein the antenna is supported within the plasma chamber by a removable support engaging a cutout region formed in one of said chamber walls, the antenna extending into said chamber interior from a region outside said chamber, said removable support comprising:

a metal insert for supporting the antenna and having dimensions to fit within the cutout region of the chamber wall while positioning the exposed metal portion of the antenna within said ionization zone in said chamber interior.

7. A method of creating a plasma of ions within a chamber for use with an ion implanter, said method comprising the steps of:

a) providing a plasma chamber having conductive chamber walls that bound an ionization zone in a chamber interior bounded by the conductive chamber walls, and further providing an exit opening that allow ions created within the chamber interior to exit the plasma chamber;

b) positioning said plasma chamber relative to structure for forming an ion beam from said ions exiting said plasma chamber;

c) providing a metallic antenna with an exposed metal surface that extends into the chamber interior for emitting energy into the plasma chamber, wherein said antenna includes a generally U-shaped tube having two legs, and each of said legs has an end disposed outside said plasma chamber; and d) energizing the metallic antenna with a radio frequency signal by connecting a radio frequency power source having two outputs to the ends of said two antenna legs to set up an alternating electric current in said metallic antenna that induces an ionizing electric field in proximity to the metallic antenna within the plasma chamber for ionizing an ionizable material located in the plasma chamber and creating a plasma of ions that are emitted through the opening for formation of said ion beam.

8. The method of claim 7 further comprising the step of shielding the exposed metal surface of the antenna in a region of the chamber susceptible to contamination due to sputtering of material onto the antenna.

9. The method of claim 8 wherein the step of providing a metallic antenna comprises the substeps of providing a cutout region in one of said chamber walls and mounting the antenna to an insert that fits into the cutout region of said wall.

10. The method of claim 9 wherein the insert is secured to the chamber wall by means of a magnet that attracts a ferromagnetic member attached to one of the wall or the insert.

11. An ion implanter comprising:

a) an ion implantation chamber for positioning one or more workpieces within an evacuated region for ion beam treatment of the workpieces;

b) an ion source for generating a plasma of ions suitable for forming an ion beam for treating the workpieces within the evacuated region of the implantation chamber; said ion source comprising conductive chamber walls that bound an ionization zone in a chamber interior to form a plasma chamber for receiving an ionizable material, said plasma chamber including a wall defining one or more exit openings for allowing said ions to exit the plasma chamber;

c) structure for establishing an evacuated beam path from the ion source to the ion implantation chamber and for shaping the ion beam within the evacuated beam path;

d) a support for positioning said plasma chamber relative to said structure for establishing an evacuated beam path;

e) a metallic antenna including a metal surface exposed within the chamber interior for emitting energy into the plasma chamber, the antenna including two legs that are connected together within the plasma chamber, and wherein each of said legs has an end disposed outside said plasma chamber; and f) an energy source for energizing the metallic antenna with a radio frequency signal, said energy source having two outputs connected to the ends of the two legs of said antenna to set up an alternating electric current in said metallic antenna for inducing an ionizing electric field in proximity to the metallic antenna within the plasma chamber.

12. The ion implanter of claim 11 wherein the antenna includes a U-shaped segment supported within the plasma chamber.

13. The ion implanter of claim 11 wherein the antenna comprises an aluminum U-shaped segment supported within the plasma chamber.

* * * * *